United States Patent [19]

Berg

[11] 4,264,539

[45] Apr. 28, 1981

[54] LIQUID FUEL VAPORIZER

[75] Inventor: Roy E. Berg, Fort Lauderdale, Fla.

[73] Assignee: Samuel Ray Dickenson, Hollywood, Fla. ; a part interest

[21] Appl. No.: 102,755

[22] Filed: Dec. 12, 1979

[51] Int. Cl.[3] ..... B01F 3/04

[52] U.S. Cl. ..... 261/142; 48/180 H; 219/273; 261/90; 261/DIG. 65

[58] Field of Search ..... 261/90, 142, DIG. 65; 48/180 H; 219/271, 273, 275

[56] References Cited

U.S. PATENT DOCUMENTS

| | | | |
|---|---|---|---|
| 1,765,125 | 6/1930 | Brewer | 261/142 |
| 1,791,949 | 2/1931 | Boulade | 261/142 |
| 1,998,784 | 4/1935 | Mock . | |
| 2,105,887 | 1/1938 | Langford | 261/142 |
| 2,223,381 | 12/1940 | Mock . | |
| 2,265,199 | 12/1941 | Schmidt . | |
| 2,294,743 | 9/1942 | Funderburk | 261/142 |
| 2,576,475 | 11/1951 | Perrine . | |
| 2,759,713 | 8/1956 | Maniscalco, Sr. | 261/142 |
| 3,273,549 | 9/1966 | Deland . | |

*Primary Examiner*—Richard L. Chiesa
*Attorney, Agent, or Firm*—Oltman and Flynn

[57] ABSTRACT

Liquid fuel, such as gasoline, kerosene, or naptha, is sprayed through a tube into a centrifugal blower. The fuel supply tube extends concentrically through a central collar on the blower casing at one axial side of the blower, and ambient air is supplied through this collar into the blower. Manually adjustable valves control the supply of liquid fuel and air, respectively. The blower casing has an outlet for vaporized fuel at the same side of the blower as the central collar. An electrical heating element on the casing keeps the fuel vaporized inside. An electric motor which drives the blower is bolted to the opposite side of the casing. A holder encircles the motor outside the blower casing, and a handle connects this holder to the casing. Support legs extend down from the blower casing and the motor holder.

5 Claims, 5 Drawing Figures

LIQUID FUEL VAPORIZER

BACKGROUND OF THE INVENTION

The present invention relates to an apparatus for vaporizing a liquid fuel, such as gasoline, kerosene or naptha.

In accordance with a presently-preferred embodiment of the invention, liquid fuel and air are discharged into a centrifugal blower which causes the fuel to become vaporized. The blower is in a casing which is heated by an electrical heating element to maintain the fuel in its vaporized state as it flows to an outlet on the casing. The flow rate of liquid fuel and the flow rate of air into the blower are separately adjustable by respective values, so that the user can adjust the density of the vaporized fuel output from the converter. The vaporized fuel outlet is located axially to one side of the blower to promote additional mixing of the vaporized fuel after it emerges from the blower and before it reached the fuel outlet.

A principal object of this invention is to provide a novel and improved apparatus for vaporizing liquid fuel.

Another object of this invention is to provide such an apparatus in which the density of the vaporized fuel is selectively adjustable.

Another object of this invention is to provide a novel fuel vaporizing apparatus in which liquid fuel and air are mixed in a centrifugal blower before being discharged into a casing which is externally heated to maintain the fuel vaporized.

Further objects and advantages of this invention will be apparent from the following detailed description of a presently preferred embodiment thereof, which is shown in the accompanying drawings.

Before explaining the disclosed embodiment of the present invention in detail, it is to be understood that the invention is not limited in its application to the details of the particular arrangement shown since the invention is capable of other embodiments. Also the terminology used herein is for the purpose of description and not of limitation.

DETAILED DESCRIPTION

Figure 5:
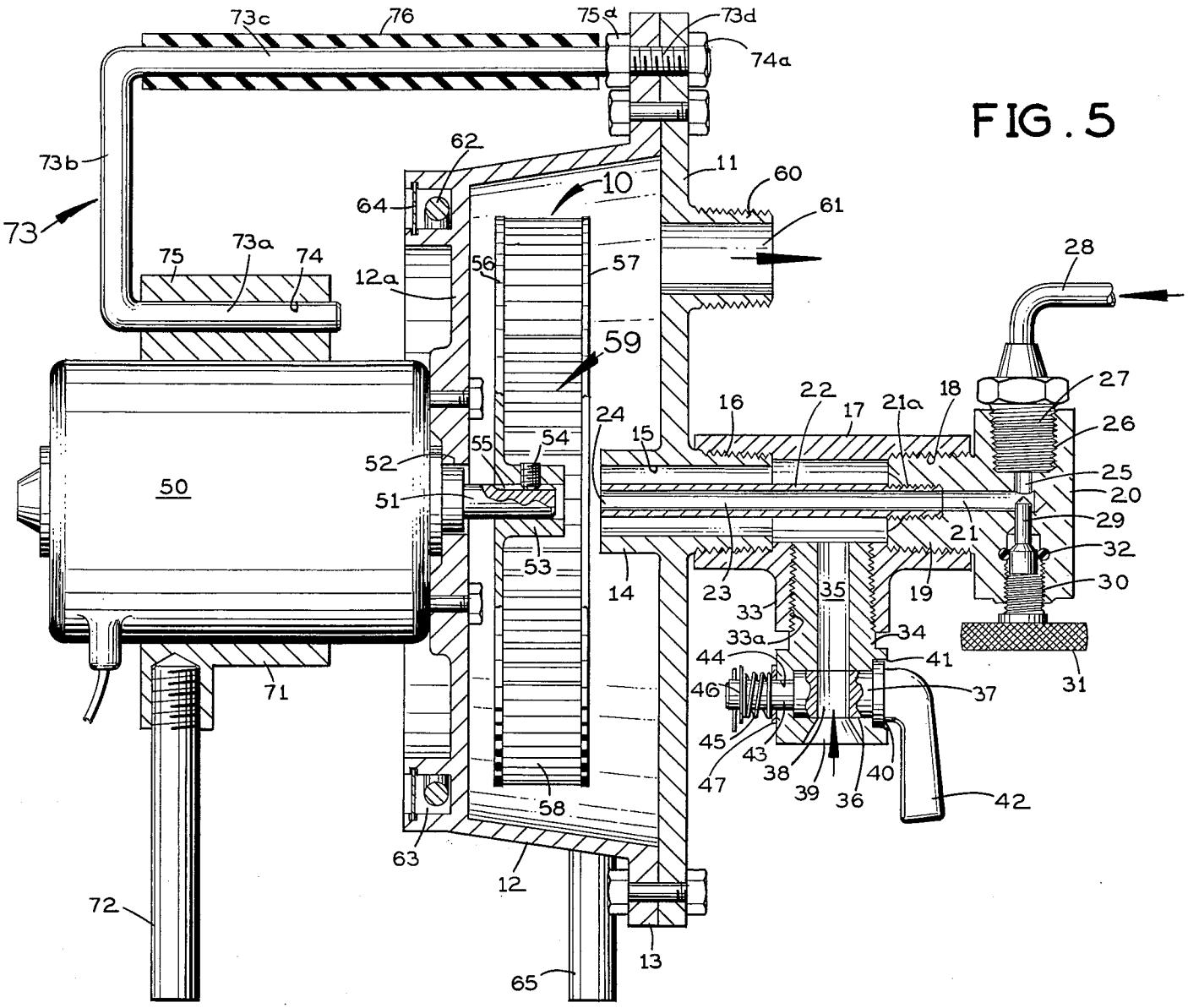
FIG. 5 is a vertical longitudinal section taken along the line 5—5 in FIG. 1.

Referring first to FIG. 5, the present vaporizer comprises a rotary centrifugal blower 10 of conventional construction enclosed in a two-piece casing which has a front plate 11 and a generally cup-shaped rear body 12 with an annular peripheral flange 13 at the front which is bolted to the front plate 11 in gas-tight fashion.

The front plate 11 of the casing has an integral annular collar 14 at the center which projects axially on opposite sides of this plate. This collar is formed with a cylindrical longitudinal bore 15 leading into the interior of the casing. At the inside of the casing this collar terminates a short distance axially to the right of the blower 10. At the outside of the casing, the central collar 14 is externally screw-threaded and slightly tapered, as shown at 16.

A T-fitting 17 is screw-threadedly attached at one end to the threaded segment 16 of the central collar on the casing front plate 11. The opposite end of this T-fitting is internally screw-threaded at 18, where it threadedly receives an externally screw-threaded nipple 19 on a valve body 20. The valve body 20 is formed with a horizontal bore 21 extending into the nipple 19 and terminating there in a screw-threaded recess 21*a*. A cylindrical metal tube 22 has an externally screw-threaded end which is threadedly received in the threaded recess 21*a* in the valve body 20. This tube extends concentrically through the upper end of the T-fitting 17 and through the central collar 14 on the front plate 11 of the casing. The tube 22 presents a cylindrical passageway 23 which at its right end in FIG. 5 is open to the valve body bore 21 and at the opposite end presents a discharge opening 24. This end of the tube 22 lies in the same vertical plane as the inner end of the central collar 14 on the casing front plate, and it is located a short distance to the right of the blower 10.

The valve body 20 is formed with a short vertical bore 25 which extends from a screw-threaded recess 26 in the top down into the outer end of the horizontal bore 21. An externally screw-threaded annular fitting 27 is threadedly received in recess 26 for passing liquid fuel from a supply pipe 28 down into the vertical bore 25. A needle valve 29 is below the bore 25 and is vertically adjustable to regulate the flow rate of liquid fuel into the valve body bore 21 and from there into the tube 22. The needle valve has a screw-threaded stem 30 which is threadedly received in the valve body 20 and a knurled knob 31 at its lower end below the valve body. An O-Ring seal 32 prevents leakage past the needle valve. By grasping the knob 31 and turning the needle valve, the user may adjust the flow rate of liquid fuel into the centrifugal blower 10.

The T-fitting 17 has a downwardly extending, annular leg 33 located midway along its length and internally screw-threaded as shown at 33*a*. A valve body 34 has an externally screw-threaded upper end which is threadedly received in this leg of the T-fitting. This valve body presents a vertical bore 35 which leads up into the interior of the T-fitting 17 for passing air to the bore 15 of the central collar 14 on the casing front plate 11. The valve body 34 presents a cylindrical recess 36 which intersects the vertical bore 35 at the latter's lower end and extends horizontally on opposite sides of this bore.

A complementary cylindrical valve member 37 is rotatably seated in the valve body recess 36. This valve member is formed with a cylindrical cross passage 38 which registers fully with the valve body bore 35 in one rotational position of valve member 37. The valve body 34 is formed at its lower end with a flared opening 39 which extends down from the recess 36 and is vertically aligned with the valve body bore 35.

The valve member 37 has a cylindrical enlargement 40 which is snugly but rotatably received in a complementary counter-bore 41 formed in the valve body 34 to the right of its recess 36 in FIG. 5. A valve handle 42 extends down from this enlargement. As the opposite side of the recess 36, the valve member 37 presents a reduced cylindrical segment 43 which extends through a complementary opening 44 in this side of the valve body 34. A coil spring 45 is engaged under compression between a washer 46, which is carried by the reduced segment 43 of valve member 37, and a washer 47, which abuts against the outside of the valve body 34 at this side. This spring holds the valve member 37 in the position shown in FIG. 5, with its enlargement 40 seated in the valve body recess 41 and its cross passage 38 adapted to register with the vertical bore 35 and the flared opening 39 in the valve body 34.

The opening 39 admits ambient air, and the rotational setting of the valve member 37 can be adjusted by handle 42 to restrict the air flow rate up into the bore 35 in the valve body 34.

The generally cup-shaped casing body 12 presents a back wall 12*a* which extends generally parallel to the front plate 11 of the casing. A drive motor 50, preferably a small electric motor, is bolted to this back wall 12*a* and the rotary output shaft 51 of this motor extends through a central opening 52 in this wall for reception in a central annular hub 53 of the blower. A set screw 54 fastens the blower hub 53 to the motor shaft 51 at a longitudinal groove 55 in the latter which permits axial adjustment of the blower 10 toward or away from the liquid fuel discharge opening 24 for optimum performance.

The blower 10 has a flat back wall 56 formed integral with its central hub 53 and extending perpendicularly outward from the motor shaft. The blower has a flat, annular, front wall 57 spaced in front of its back wall 56 and extending parallel to it. A plurality of circumferentially spaced vanes or blades 58 extend between the back and front walls just inward from the periphery of the blower, and these vanes or blades define passages between them in succession circumferentially. Radially inward from the vanes or blades 58 the blower has a central chamber 59 into which liquid fuel is discharged from the pipe 22 and an encircling ring of air is discharged through the passageway 15 is the central collar 14 of the casing front wall 11.

The liquid fuel and air mix with each other in the blower chamber 59 and the fuel becomes vaporized, so that the fuel-air mixture escaping centrifugally through the passages between the blower's vanes or blades 58 is in a gaseous state. The front wall 11 of the casing has an externally screw-threaded nipple 60 which defines an outlet passageway through which the vaporized fuel leaves the interior of the casing. A hose or pipe (not shown) conducts the vaporized fuel from the outlet nipple 60 to the fuel burning apparatus which utilizes it.

The casing 11, 12 is heated by an electrical heating element 62 located in a circumferentially extending recess 63 on the back wall 12*a* of the casing. A snap ring 64 retains the heating element 52 in place. This heating element produces enough heat to replace the heat lost in the vaporization of the liquid fuel in the blower 10, so that the vaporized fuel does not condense on the walls of the casing but instead remains in a vaporized state as it flows to the outlet passage 61.

Figure 1:
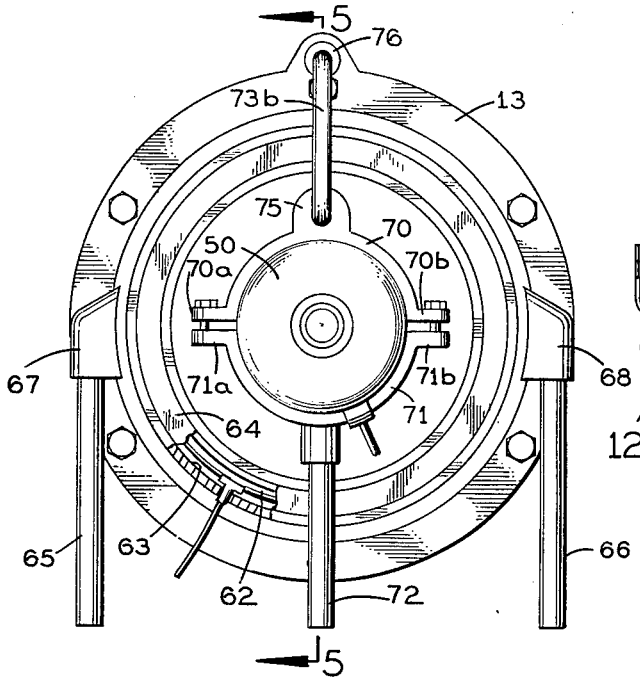
FIG. 1 is an end elevational view of the present vaporizer.
Figure 2:
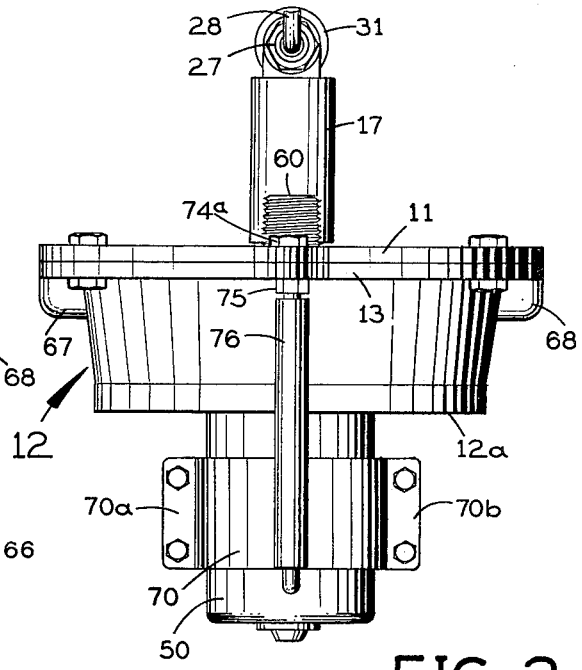
FIG. 2 is a top plan view.
Figure 4:
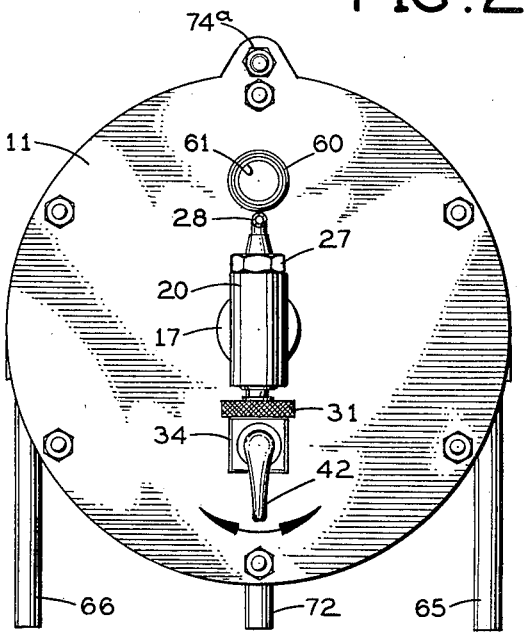
FIG. 4 is an end elevation taken from the opposite end of the vaporizer.
Figure 3:
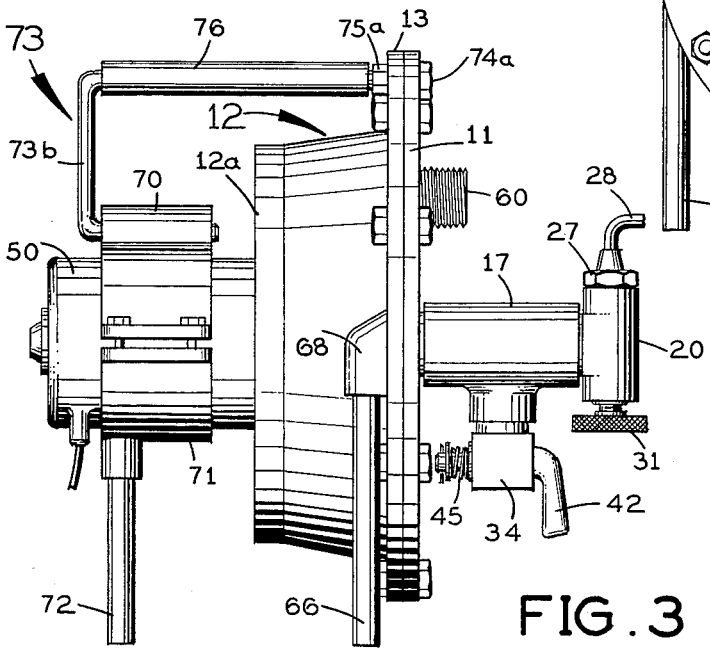
FIG. 3 is a side elevation taken from the right side of FIGS. 1 and 2.

Referring to FIG. 1, the casing 11, 12 of the blower is supported by a pair of vertical legs 65 and 66, which extend down from it on opposite sides. The upper ends of these legs are received in respective sockets 67 and 68 on the back of the front flange 13 of the casing body 12.

The drive motor 50 for the blower 10 is held by a two-piece annular holder 70, 71 (FIG. 1), having generally semicircular upper and lower pieces with outwardly projecting lips 70*a*, 71*a* and 70*b*, 71*b* on opposite sides which are bolted together to hold the motor in place. A vertical leg 72 extends down from the lower piece 71 of the motor holder to form the third leg of a three-legged support for the converter (the other legs being the previously mentioned legs 65 and 66).

Additionally rigidity is provided by a rigid rod 73 having a horizontal bottom leg 73*a* (FIG. 5), which is snugly received in an opening 74 extending through a rounded projection 75 on the top of the upper piece 70 of the motor holder. The rod has a vertical leg 73*b* extending up from the back end of its lower leg 73*a*, and a horizontal top leg 73*c* extending parallel to the bottom leg. This top leg has a screw-threaded front end segment 73*d* which extends through registering openings in the front flange 13 on the casing body 12 and the front plate 11 of the casing. A pair of nuts 74*a* and 75*a* clamp the threaded end segment 73*d* of the rod in place. A hose 76 of rubber-like material encloses the top leg 73*c* of the connecting rod 73 for most of its length and provides a handle enabling the entire unit to be carried conveniently.

In the operation of this apparatus, liquid fuel is discharged through the tube 22 into the blower chamber 59 at a rate determined by the setting of the needle valve 29. Air is drawn into the blower chamber 59 in an annular stream which encircles the liquid fuel as the latter emerges from the fuel discharge opening 24. The air flow rate is regulated by the rotational setting of the valve member 37. The input air flow rate is adjusted to be much lower than the output of the centrifugal blower 10. The air and fuel mix inside the blower and vaporization of the liquid fuel takes place, so that a fuel-air mixture is discharged in a gaseous state thorugh the passages between the blades 58 at the periphery of the blower. Further mixing of the fuel and air components of the fuel-air mixture takes place by recirculation outside the blower in the casing 11, 12 which is heated to prevent the fuel from liquifying. The location of the gas outlet passage 61 axially to one side of the blower instead of directly outside its periphery insures that considerable circulation of the fuel-air mixture can take place after it emerges from the blower 10 and before it reaches the outlet passage 61. This helps to produce a more uniform, thoroughly mixed, stabliized gas. The restricted flow rate of the air entering the blower 10 also contributes to this effect.

I claim:

1. In a liquid fuel vaporizer having:

a centrifugal blower having an axis;

an electric motor driving said blower;

a casing enclosing said blower and having an outlet for vaporized fuel;

and means for introducing liquid fuel and air into the blower for vaporizing the fuel;

the improvement wherein:

said means for introducing liquid fuel and air comprises an axial collar on the casing at one axial side of the blower, a pipe extending coaxially longitudinally through said collar, a manually adjustable valve, for admitting liquid fuel into said pipe, and a manually adjustable valve for admitting ambient air into said collar to flow along the inside of said collar outside said pipe;

said outlet for vaporized fuel is on the casing radially outward from the axis of the blower at said one axial side of the blower;

said motor is on the outside of the casing at the opposite axial side of the blower;

and means restricting the air flow into said blower to substantially less than the output of said blower so that vaporized fuel and air are mixed flowing into the axis of said blower and are further mixed by recirculating in a circular path within said casing through said blower before emerging from said outlet.

2. A vaporizer according to claim 1, wherein said casing has an annular recess on the outside at said opposite side of the blower, and further comprising an electrical heating element in said recess for maintaining the fuel vaporized between the blower and said outlet.

3. A vaporizer according to claim 2, and further comprising a holder supporting said motor at the outside of the casing, and means defining a handle connecting said holder to said casing and extending in spaced relationship above said holder.

4. A vaporizer according to claim 3, and further comprising a pair of legs extending down from said casing at opposite sides circumferentially of the blower, and a third leg extending down from said holder for the motor.

5. A vaporizer according to claim 1, and further comprising:

heater means in heat transmitting relationship to said casing for heating the latter to maintain the fuel vaporized between the blower and said outlet;

a holder supporting said motor at the outside of the casing;

and means defining a handle connecting said holder to said casing and extending in spaced relationship above said holder.

* * * * *